US008567674B2

(12) United States Patent
Conaghan et al.

(10) Patent No.: US 8,567,674 B2
(45) Date of Patent: Oct. 29, 2013

(54) TWO-SIDED SHEET CONTAINING A PLURALITY OF DIFFERENT TRAVEL-RELATED DOCUMENT ITEMS AND A METHOD OF OPERATING AN APPARATUS TO PROVIDE SUCH A TWO-SIDED SHEET

(75) Inventors: Erin Conaghan, Johns Creek, GA (US); Jody Brookshire, Flowery Branch, GA (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/407,386

(22) Filed: Feb. 28, 2012

(65) Prior Publication Data

US 2013/0221081 A1 Aug. 29, 2013

(51) Int. Cl.
*G07B 15/02* (2011.01)

(52) U.S. Cl.
USPC ..... 235/384

(58) Field of Classification Search
USPC ..... 40/6; 235/384, 487
See application file for complete search history.

(56) References Cited

U.S. PATENT DOCUMENTS

| | | | | |
|---|---|---|---|---|
| 5,051,565 | A * | 9/1991 | Wolfram | 235/384 |
| 5,145,211 | A * | 9/1992 | McKillip | 283/80 |
| 5,707,082 | A * | 1/1998 | Murphy | 283/67 |
| 5,920,053 | A * | 7/1999 | DeBrouse | 235/375 |
| 6,488,228 | B2 * | 12/2002 | Davies et al. | 242/556.1 |
| 6,735,575 | B1 * | 5/2004 | Kara | 705/50 |
| 7,225,993 | B2 * | 6/2007 | Warther | 235/492 |
| 2006/0026871 | A1 * | 2/2006 | Alexander et al. | 40/6 |

* cited by examiner

*Primary Examiner* — Seung Lee
(74) *Attorney, Agent, or Firm* — Michael Chan

(57) ABSTRACT

A two-sided sheet contains a plurality of different travel-related items. The two-sided sheet includes a first travel-related item in the form of a baggage tag having a front major surface facing a first direction and on which baggage tag information is printed. The two-sided sheet also includes a second travel-related item which is other than a baggage tag and which second travel-related item has a front major surface facing a second direction which is opposite the first direction and on which other information is printed. The two-sided sheet further includes adhesive disposed between the first and second travel-related items to provide a single sheet in which the second travel-related item can be peeled away and separated from the baggage tag.

17 Claims, 6 Drawing Sheets

TWO-SIDED SHEET CONTAINING A PLURALITY OF DIFFERENT TRAVEL-RELATED DOCUMENT ITEMS AND A METHOD OF OPERATING AN APPARATUS TO PROVIDE SUCH A TWO-SIDED SHEET

BACKGROUND

The present application relates to travel-related document items such as baggage tags and boarding passes, and is particularly directed to a two-sided sheet containing a plurality of different travel-related document items and a method of operating an apparatus to provide such a two-sided sheet.

When a passenger travels via a transportation provider, such as a plane, a boarding pass is usually printed and provided to the passenger so that the passenger can later present the boarding pass to board the plane. If the passenger has a piece of baggage to check in, a baggage tag is usually printed and attached to the baggage. A baggage claim stub is also usually provided to the passenger so that the passenger can later present the baggage claim stub to claim and/or identify the baggage. A baggage receipt may also be provided to the passenger when, for example, baggage (or excess baggage) has been checked in and fees have been paid. Baggage receipts, baggage claim stubs, baggage tags, and boarding passes are example different types of travel-related document items. It would be desirable to improve ways in which travel-related document items are provided to a passenger when the passenger travels via a transportation provider.

SUMMARY

In accordance with one embodiment, a two-sided sheet contains a plurality of different travel-related items. The two-sided sheet comprises a first travel-related item in the form of a baggage tag having a front major surface facing a first direction and on which baggage tag information is printed. The two-sided sheet also comprises a second travel-related item which is other than a baggage tag and which second travel-related item has a front major surface facing a second direction which is opposite the first direction and on which other information is printed. The two-sided sheet further comprises adhesive disposed between the first and second travel-related items to provide a single sheet in which the second travel-related item can be peeled away and separated from the baggage tag so that the baggage tag can be secured to a piece of passenger luggage using at least a portion of exposed adhesive after the second travel-related item has been peeled away and separated from the baggage tag.

In accordance with another embodiment, a combined baggage tag and boarding pass comprises a first facestock material having a back major surface and a front major surface on which baggage tag information is printed. The combined baggage tag and boarding pass also comprises a second facestock material having a back major surface and a front major surface on which boarding pass information is printed. The combined baggage tag and boarding pass further comprises adhesive disposed between the back major surface of the first facestock material and the back major surface of the second facestock material such that (i) at least a portion of the second facestock material can be peeled away and separated from the adhesive and the first facestock material and used as a passenger boarding pass, and (ii) the first facestock material and at least a portion of the adhesive can be attached to a piece of baggage and used as a passenger baggage tag.

In accordance with yet another embodiment, a method of operating an apparatus is provided to provide on-demand printing of a two-sided sheet item which contains a plurality of different travel-related items. The method comprises printing baggage tag information onto a front major surface of a first travel-related item in the form of a baggage tag disposed on a first major side surface of the two-sided sheet item. The method also comprises printing other information onto a front major surface of a second travel-related item disposed on a second major side surface of the two-sided sheet item. The method further comprises delivering the printed baggage tag and the printed second travel-related item together as a single sheet to provide a combined baggage tag and other travel-related item in which the second travel-related item can be peeled away and separated from the baggage tag so that the baggage tag can be secured to a piece of passenger luggage using at least a portion of exposed adhesive after the second travel-related item has been peeled away and separated from the baggage tag.

DETAILED DESCRIPTION

Figure 1:
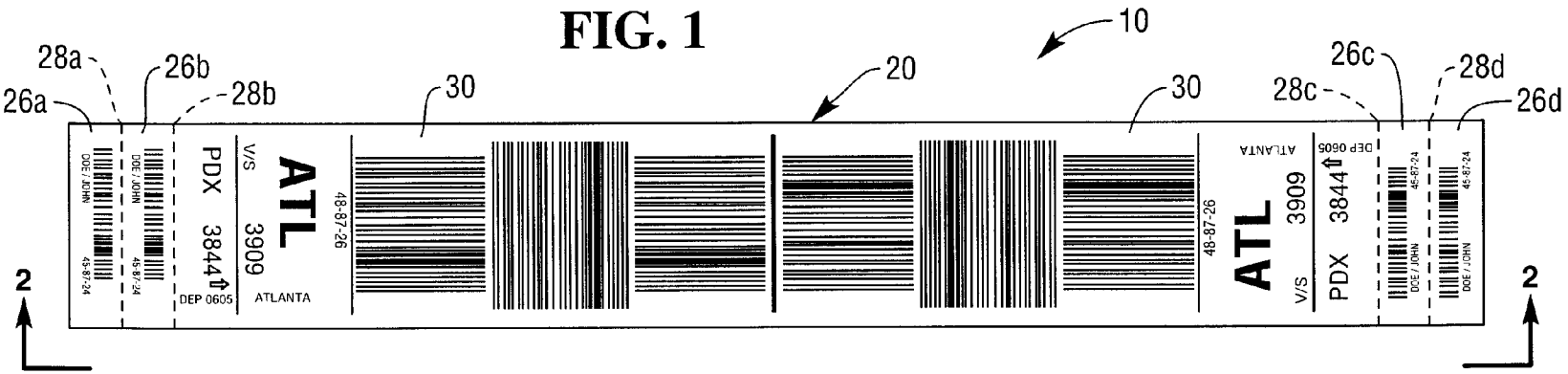
FIG. 1 is an elevational view showing front of a baggage tag portion of a combined baggage tag and boarding pass constructed in accordance with one embodiment.
Figure 3:
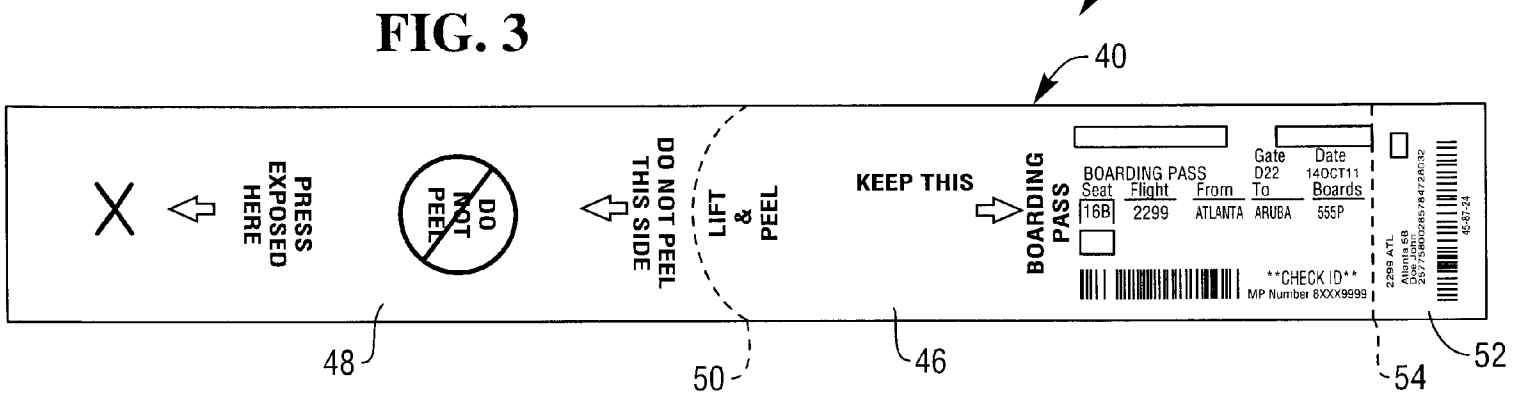
FIG. 3 is an elevational view looking approximately in the direction of arrow "3" in FIG. 2, and showing front of a boarding pass portion of the combined baggage tag and boarding pass.
Figure 2:
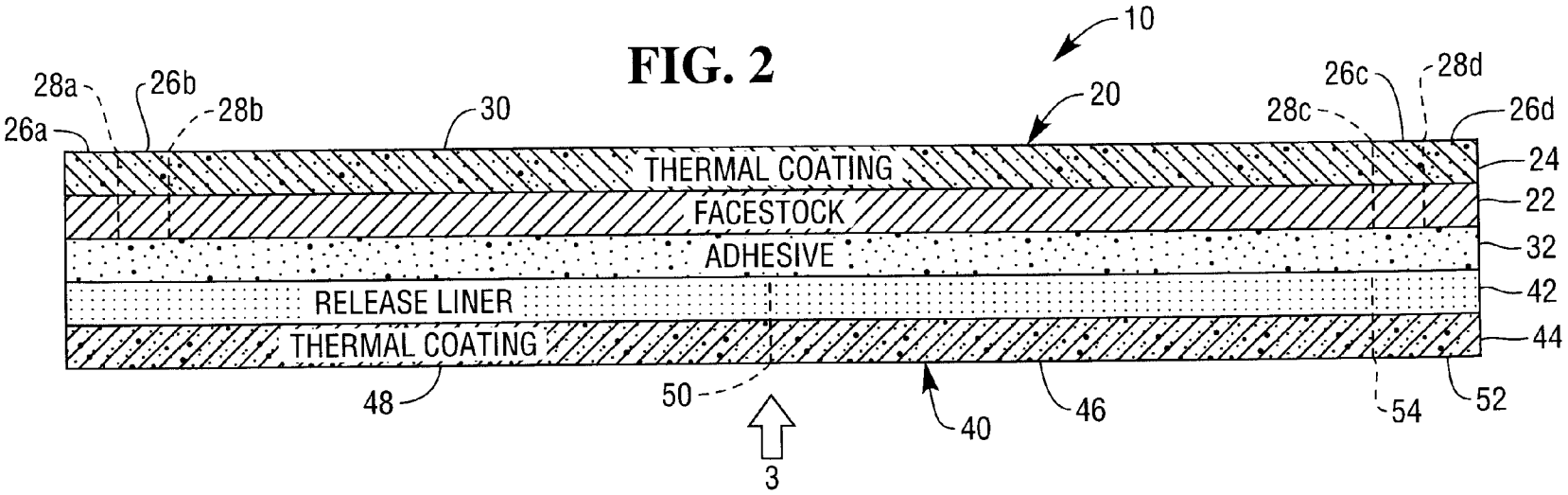
FIG. 2 is a cross-sectional view taken approximately along line 2-2 in FIG. 1, and showing layers of material of the combined baggage tag and boarding pass.

Referring to FIGS. 1-3, example combined baggage tag and boarding pass 10 has a baggage tag portion 20 (FIG. 1) and a boarding pass portion 40 (FIG. 3). Baggage tag portion 20 includes a layer of facestock material 22 (FIG. 2) coated with thermal coating layer 24. Facestock material layer 22 and thermal coating layer 24 may comprise a sheet made of paper and film, for example. Facestock material layer 22 and thermal coating layer 24 may comprise synthetic material which provides durability and performance in a baggage handling environment such as at an airport. Facestock material layer 22 and thermal coating layer 24 may comprise material which meets baggage tag guidelines as set forth by the International Air Transport Association (IATA).

Boarding pass portion 40 includes a layer of release liner material 42 (FIG. 2) coated with thermal coating layer 44. Release liner material 42 and thermal coating layer 44 may comprise Super Calendered Kraft (SCK) paper, for example, which is a bleached white paper used as a release liner with many roll label products. Different types of release liner materials may be used. Thermal coating layer 44 may comprise a direct thermal coating, for example. As shown in FIG. 2, adhesive layer 32 is disposed between one side of facestock material layer 22 of baggage tag portion 20 and one side of release liner material layer 42 of boarding pass portion 40.

As shown in FIG. 1, baggage tag information is printed on front major side 30 of baggage tag portion 20. Baggage tag portion 20 includes four peer tags 26*a*, 26*b*, 26*c*, 26*d* which are attached with perforations 28*a*, 28*b*, 28*c*, 28*d*, as shown in FIG. 1. Although four peer tags are shown in FIG. 1, it is conceivable that any number of peer tags or no peer tag be provided. Peer tags and their use are known in the airline industry and, therefore, will not be described. Peer tags may be known by either a different name or a different type of tag.

As shown in FIG. 3, boarding pass information is printed on front major side portion 46 of boarding pass portion 40. Perforation 50 is disposed between front side portion 46 and another front major side portion 48 of boarding pass portion 40. Bag tag application instructions are printed on front side portion 48 and front side portion 46 as shown in FIG. 3. Front side portion 46 of boarding pass portion 40 may include a baggage claim stub 52 which is attached with perforation 54 to rest of the boarding pass portion. Baggage tag information printed on baggage claim stub 52 corresponds to baggage tag information printed on front side 30 of baggage tag portion 20 shown in FIG. 1. Surface of front side 30 of baggage tag portion 20 faces a direction which is opposite the direction which surface of front side portion 46 and surface of front side portion 48 of boarding pass portion 40 face.

Figure 4:
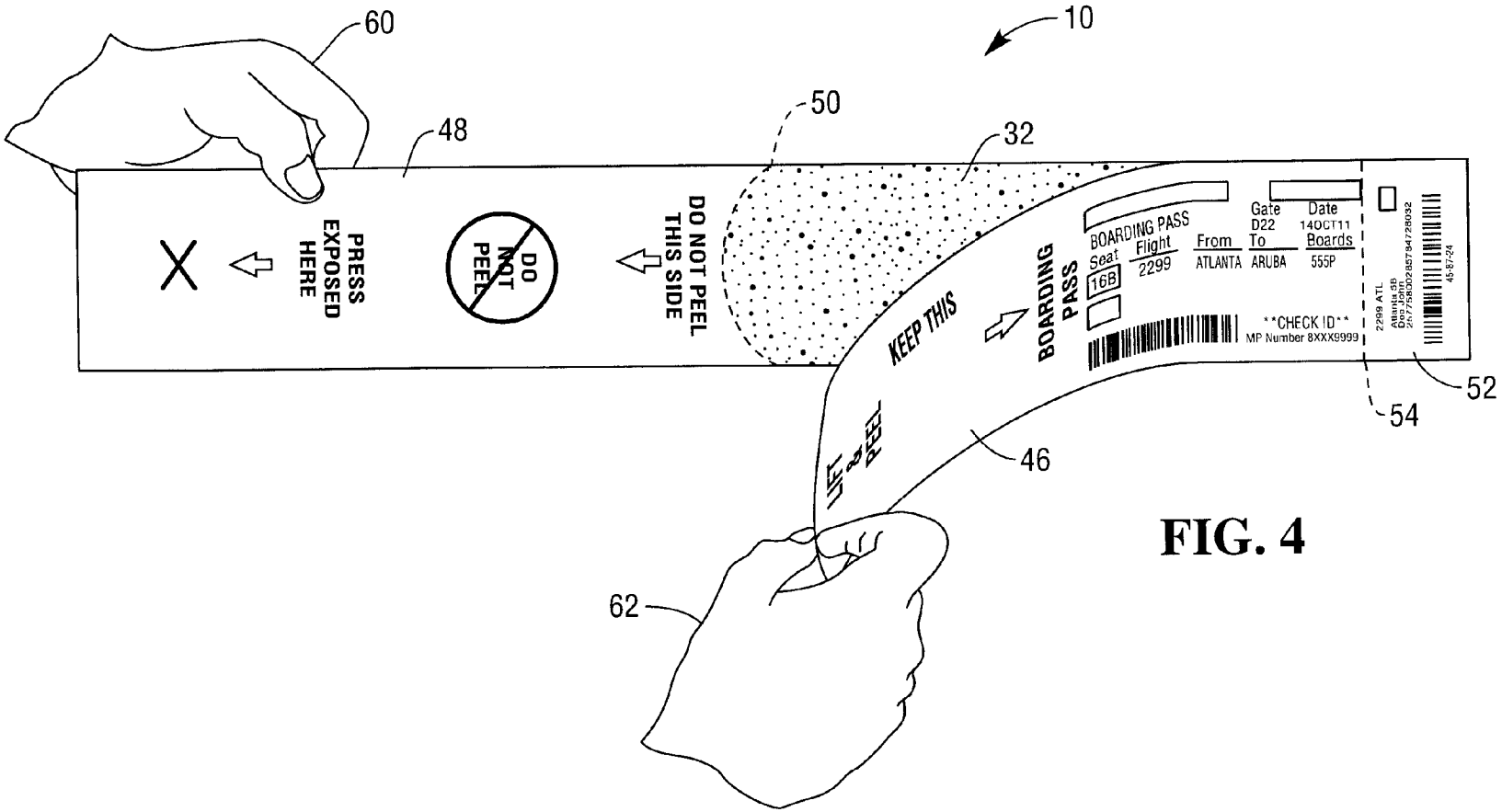
FIG. 4 is a view similar to FIG. 3, and showing the boarding pass portion being peeled away from the baggage tag portion.
Figure 5:
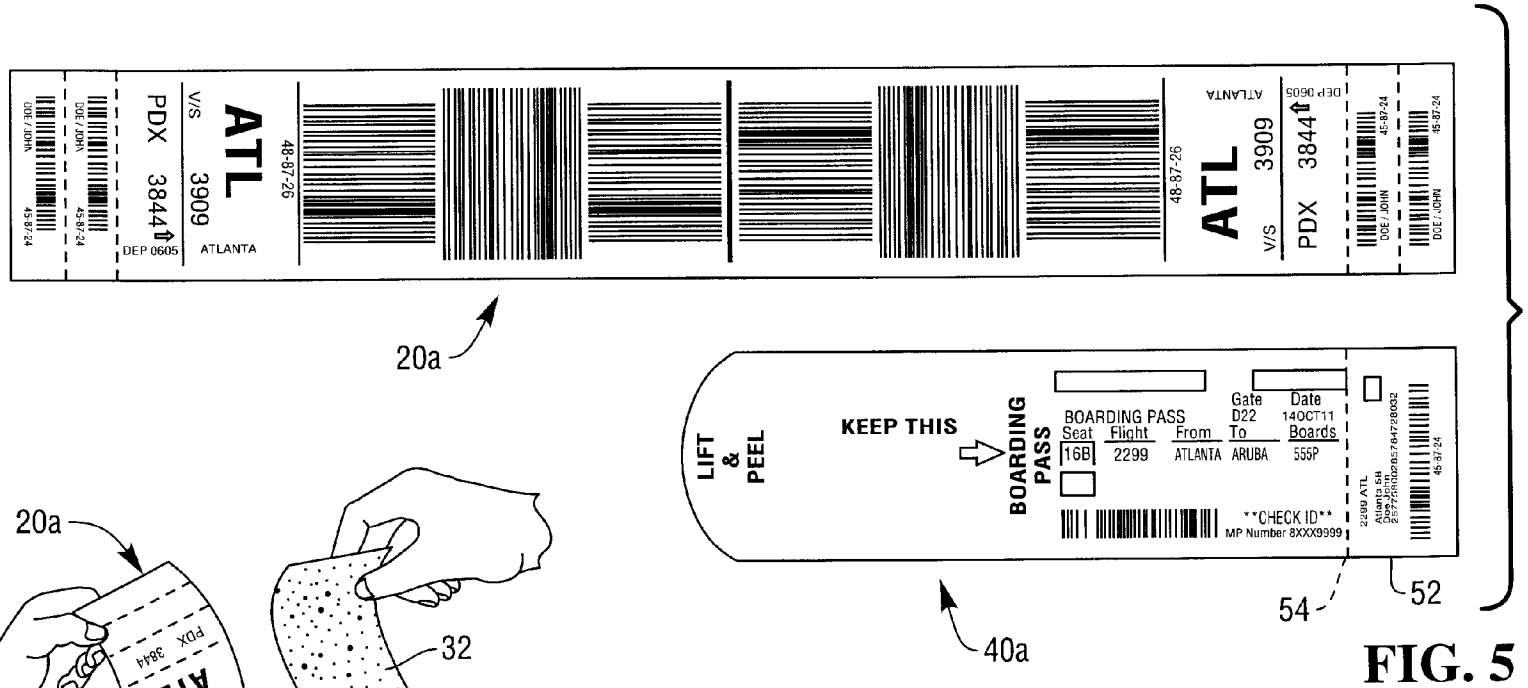
FIG. 5 is view showing the boarding pass portion of FIG. 4 completely peeled away and separated from the baggage tag portion.

Referring to FIG. 4, a person's one hand 60 is shown holding front side portion 48 while the person's other hand 62 is shown peeling away front side portion 46 away from adhesive 32 and front side portion 48. After front side portion 46 is completely peeled away and separated from adhesive 32, front side portion 46 can be used as a boarding pass. The remaining part (i.e., the adhesive 32, the front side portion 48, and the baggage tag portion 20) can be used as a baggage tag. As shown in FIG. 5, the baggage tag is designated with reference numeral "20*a*", and the boarding pass is designated with reference numeral "40*a*". It is noted that boarding pass 40*a* includes baggage claim stub 52 which may be separated at perforation 54 as described hereinabove.

Figure 6:
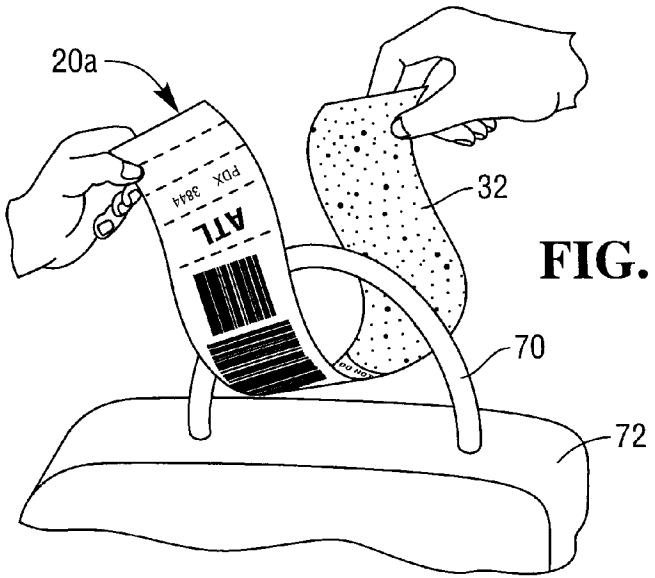
FIG. 6 is a perspective view of the baggage tag portion of FIG. 5 being attached to a piece of baggage.

Referring to FIG. 6, baggage tag 20*a* of FIG. 5 is wrapped around handle 70 of baggage 72. Baggage tag 20*a* is then folded over onto itself. As a result of boarding pass 40*a* having been separated from baggage tag 20*a*, adhesive 32 is exposed to allow baggage tag 20*a* to be folded over onto itself and thereby to be secured to handle 70 of baggage 72 in a known manner.

Although the above description describes a physical, combined baggage tag and boarding pass, it is conceivable that an electronic (i.e., non-physical) boarding pass be provided instead of a physical one. If this is the case, then the physical baggage tag may be combined with at least one other physical, travel-related document item such as a baggage claim stub, a baggage receipt for upgrades and baggage check fees and other items or services purchased, and peer tags, for examples. As another example, the combination may comprise a baggage tag and a supplemental label having promotional or informational print thereon. The supplemental label may comprise coupons, third-party advertising, baggage tag handling instructions, baggage handling instructions, baggage warranty and coverage limits, and security warnings or other industry communications, for examples.

Figure 8:
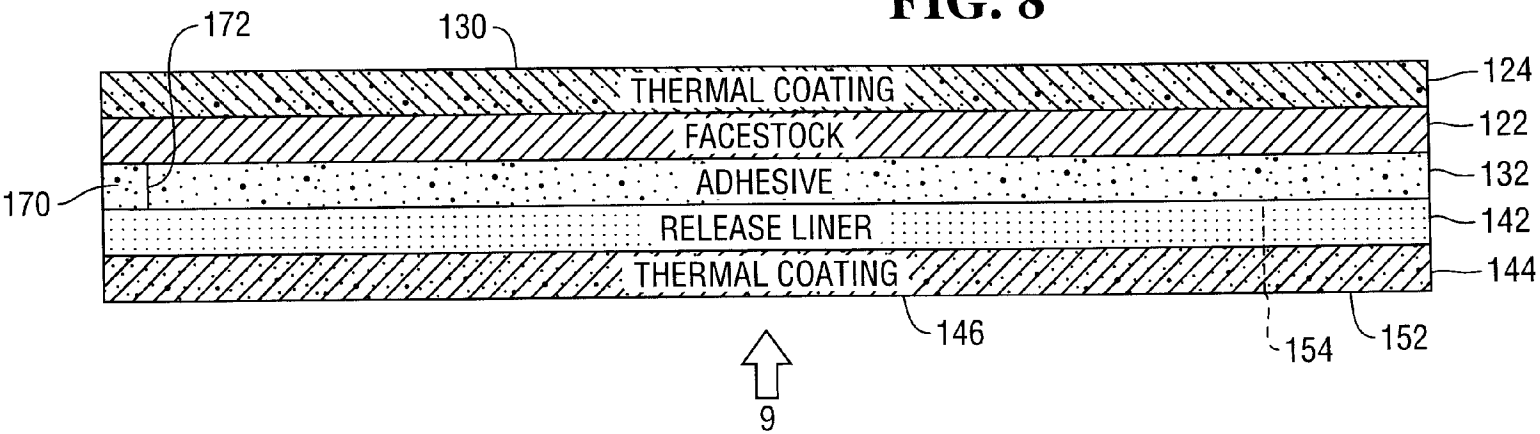
FIG. 8 is a cross-sectional view taken approximately along line 8-8 in FIG. 7, and showing layers of material of the combined baggage tag and boarding pass.
Figure 7:
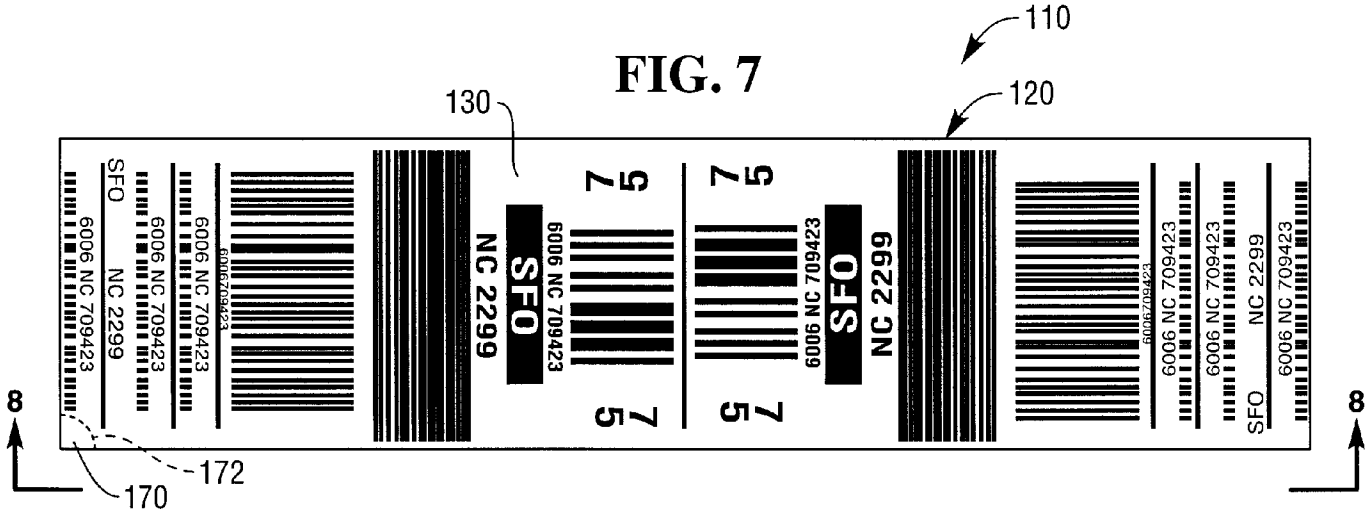
FIG. 7 is an elevational view showing front of a baggage tag portion of a combined baggage tag and boarding pass constructed in accordance with another embodiment.
Figure 9:
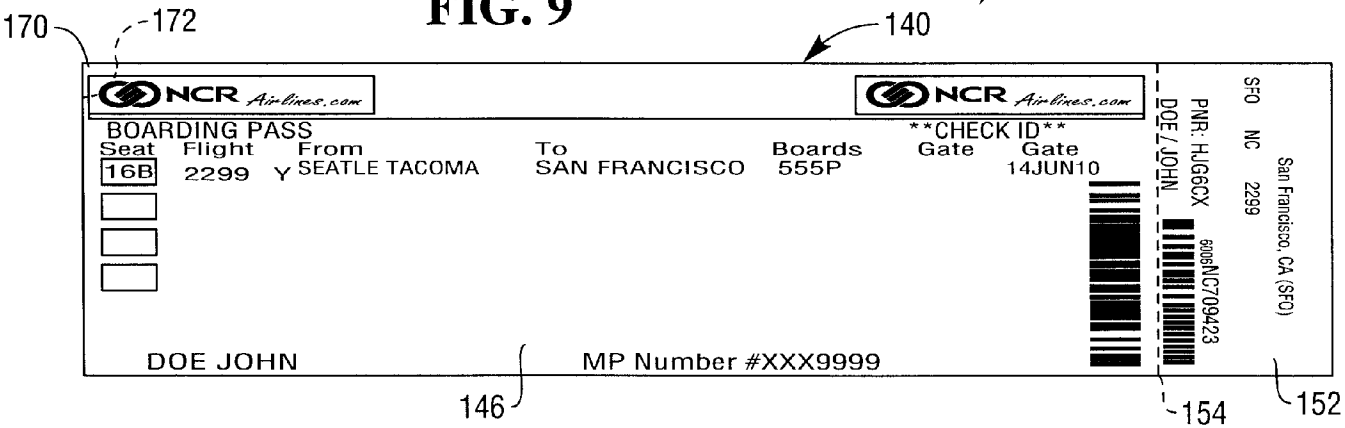
FIG. 9 is an elevational view looking approximately in the direction of arrow "9" in FIG. 8, and showing front of a boarding pass portion of the combined baggage tag and boarding pass.

Referring to FIGS. 7-9, another example combined baggage tag and boarding pass 110 has a baggage tag portion 120 (FIG. 7) and a boarding pass portion 140 (FIG. 9). Baggage tag portion 120 includes a layer of facestock material 122 (FIG. 8) coated with thermal coating layer 124. Facestock material layer 122 and thermal coating layer 124 may comprise a sheet made of paper and film, for example. Facestock material layer 122 and thermal coating layer 124 may comprise synthetic material which provides durability and performance in a baggage handling environment such as at an airport. Facestock material layer 122 and thermal coating layer 124 may comprise material which meets baggage tag guidelines as set forth by the IATA.

Boarding pass portion 140 includes a layer of release liner material 142 (FIG. 8) coated with thermal coating layer 144. Different types of release liner materials may be used. Release liner material 142 and thermal coating layer 144 may comprise SCK paper, for example. As shown in FIG. 8, adhesive layer 132 is disposed between one side of facestock material layer 122 of baggage tag portion 120 and one side of release liner material layer 142 of boarding pass portion 140.

As shown in FIG. 7, baggage tag information is printed on front major side 130 of baggage tag portion 120. As shown in FIG. 9, boarding pass information is printed on front major side 146 of boarding pass portion 140. Front side 146 of boarding pass portion 140 may include a baggage claim stub 152 which is attached with perforation 154. Baggage tag information printed on baggage claim stub 152 corresponds to baggage tag information printed on front side 130 of baggage tag portion 120 shown in FIG. 7. Surface of front side 130 of baggage tag portion 120 faces a direction which is opposite the direction which surface of front side 146 of boarding pass portion 140 faces.

Referring to FIGS. 7-9, a small corner portion 170 of the adhesive layer 132 between the facestock material layer 122 and the release liner layer 142 is shown substantially devoid (or with a relatively light amount) of adhesive. For illustration, the small corner portion 170 is shown bounded by a broken line 172 in FIGS. 7 and 9 and a solid line in FIG. 8. Small corner portion 170 of adhesive facilitates a person's finger to be easily inserted between facestock material layer 122 of baggage tag portion 120 and release liner 142 of boarding pass portion 140 so that boarding pass portion can be peeled away and separated in a similar manner as described hereinabove with respect to the embodiment of FIGS. 1-3. A baggage tag and a boarding pass are provided in a similar manner as described hereinabove with respect to FIGS. 4 and 5 for the embodiment of FIGS. 1-3. The baggage tag is attached to a piece of baggage in a similar manner as described hereinabove with respect to FIG. 6 for the embodiment of FIGS. 1-3.

Although the above description describes a physical, combined baggage tag and boarding pass, it is conceivable that an electronic (i.e., non-physical) boarding pass be provided instead of a physical one. If this is the case, then the physical baggage tag may be combined with at least one other physical travel-related document item such as a baggage claim stub, a baggage receipt for upgrades and baggage check fees and other items or services purchased, and peer tags, for examples. As another example, the combination may comprise a baggage tag and a supplemental label having promotional or informational print thereon. The supplemental label may comprise coupons, third-party advertising, travel information, baggage tag handling instructions, baggage handling instructions, baggage warranty and coverage limits, and security warnings or other industry communications, for examples.

Figure 10:
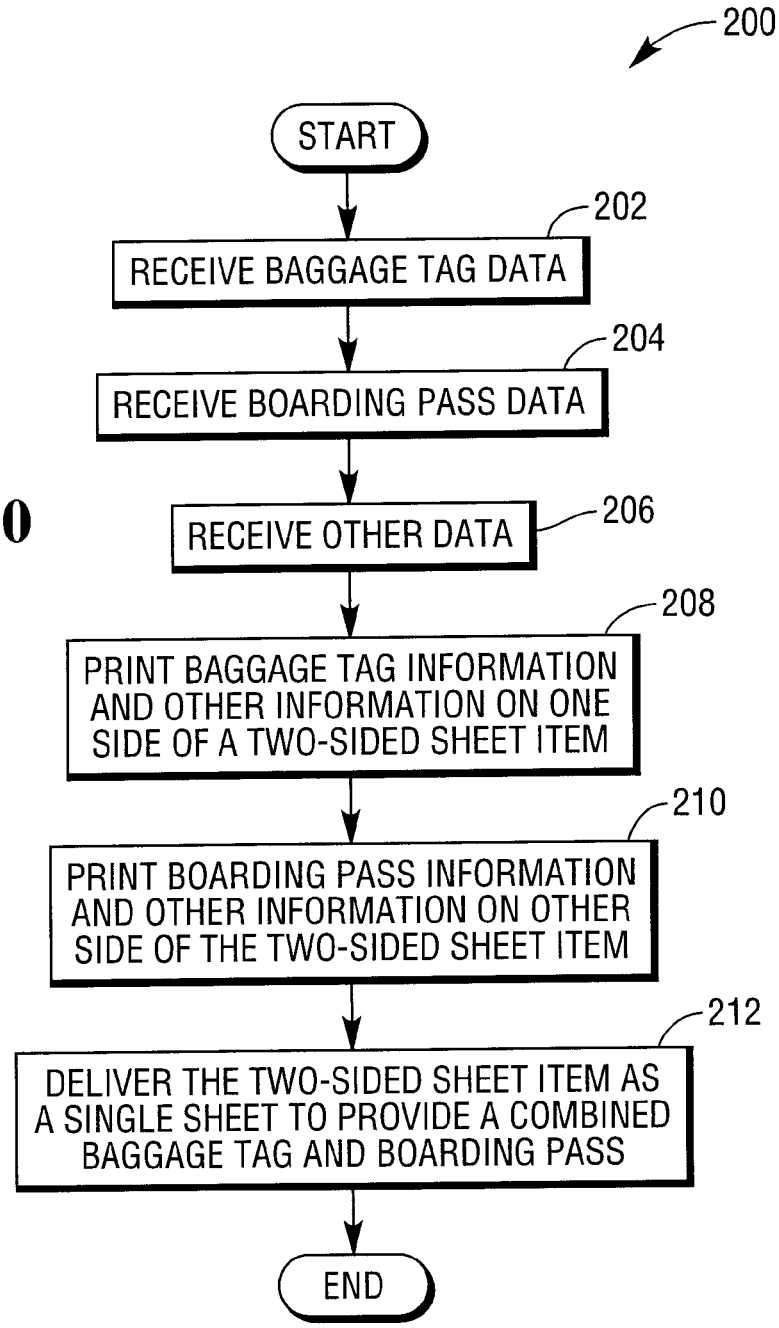
FIG. 10 is a flow diagram depicting operation of an apparatus to provide a combined baggage tag and boarding pass in accordance with one embodiment.

Referring to FIG. 10, a flow diagram 200 depicts operation of an apparatus to provide a combine and baggage tag and boarding pass in accordance with one embodiment. Any type of apparatus may be provided to print and deliver a combined baggage tag and boarding pass as described hereinabove. As an example, an apparatus in the form of a printer may be located at an airline check-in counter to print and deliver a combined baggage tag and boarding pass. As another example, an apparatus in the form of a self-service terminal or kiosk may be located at an airport to print and deliver a combined baggage tag and boarding pass.

After apparatus receives baggage tag data (step 202), boarding pass data (step 204), and other data (step 206), baggage tag information and other information are printed on one side of a two-sided sheet item (step 208). Also, boarding pass information and other information are printed on the other side of two-sided sheet item (step 210). The two-sided sheet item is then delivered as a single sheet to provide a combined baggage tag and boarding pass (step 212).

It should be apparent that a physical, travel-related document item in the form of a baggage tag is combined with at least one other physical, travel-related related document item, such as a boarding pass, a baggage claim stub, a baggage receipt, and a supplemental label which may comprise a travel coupon, third-party advertising, travel information, baggage tag handling instructions, baggage handling instructions, and a peer tag, for examples. For simplicity and purposes of explanation, a combined baggage tag and boarding pass has been described herein. It should be apparent that a baggage tag may be combined with any combination of other travel-related document items and printed on-demand as a single, two-sided sheet item.

It should be apparent that peeling away and separation of a boarding pass portion from a baggage tag portion provides a boarding pass to a passenger and, at the same time, provides a baggage tag for a piece of baggage. The peeling away and separation of boarding pass portion from baggage tag portion also exposes adhesive which allows baggage tag to be secured to the piece of baggage. Since no liner needs to be removed to expose the adhesive, waste is reduced. Also, since a single document item including a boarding pass and a baggage tag is provided, the chance of the boarding pass or the baggage tag of one passenger becoming mixed up with the boarding pass or the baggage tag of another passenger is reduced.

It should also be apparent that the above-described combined baggage tag and boarding pass may be provided in either an operated-assisted environment or a self-service environment. In an operator-assisted environment, such as at an airline check-in counter, an airline ticketing agent may peel and separate the boarding pass from the baggage tag, attach the baggage tag to the baggage, and then give the boarding pass to the passenger. In a self-service environment, such as at a kiosk, the passenger may peel and separate the boarding pass from the baggage tag, attach the baggage tag to the baggage, and then keep the boarding pass. Since the passenger customer only has to print, receive, and maintain only one document item, the customer can easily keep track of all aspects of the check-in and baggage handling process. Also, since only a single document item is printed, the airline has less consumables to order, store, and distribute. The overall process is simplified for both the airline and the passenger. This saves time and enhances their satisfaction with the process.

Although the above description describes a combined baggage tag and boarding pass having all features described, it is conceivable that the combined baggage tag and boarding pass may have any combination of the features. Combined baggage tag and boarding pass may have any combination of perforations, die cuts, and other construction elements as required to create separation areas, removable portions, receipts, and other labels as needed.

It is also conceivable that combined baggage tag and boarding pass be provided in the form of a roll, fanfold, or stack prior to entering a printer. Combined baggage tag and boarding pass may be any length. Moreover, a combined baggage tag and boarding pass may be dispensed one at a time, in multiples, or in batches. A combined baggage tag and boarding pass may be cut by a printer prior to being dispensed or by a person tearing the combined baggage tag and boarding pass. Since a single document item is printed, multiple printers may be consolidated into one printer. This reduces capital costs, maintenance expense, and square footage of the total equipment footprint.

Also, although the above description describes a combined baggage tag and boarding pass being printed using direct thermal printing, it is conceivable that other types of printing may be used. For example, inkjet printing, laser jet printing, or thermal transfer printing may be used. It is conceivable that any combination of printing types or techniques may be used. Also, blank stock or color printing as needed prior to printing baggage tag information and boarding pass information specific to the passenger transaction may be used.

Further, although the above description describes a transportation provider as being an airline, it is conceivable that the transportation provider be a different type of transportation provider. As examples, the transportation provider may be a bus line, a train, a ferry, a cruise line, or a taxi. These are example types of transportation providers, and other types of transportation providers are possible.

While the present invention has been illustrated by the description of example processes and system components, and while the various processes and components have been described in detail, applicant does not intend to restrict or in any limit the scope of the appended claims to such detail. Additional modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. Two-sided sheet containing a plurality of different travel-related items, the two-sided sheet comprising:

a first travel-related item in the form of a baggage tag having a front major surface facing a first direction and on which baggage tag information is printed;

a second travel-related item in the form of a passenger-usable travel document having a front major surface facing a second direction which is opposite the first direction and on which other information is printed; and adhesive disposed between the first and second travel-related items to provide a single sheet in which the second travel-related item can be peeled away and separated from the first travel-related item so that the separated first travel-related item can be secured as a baggage tag to a piece of passenger luggage using at least a portion of exposed adhesive after the second travel-related item has been peeled away and separated from the first travel-related item, and (ii) the separated second travel-related item can be used as a travel document by a passenger associated with the piece of passenger luggage to which the baggage tag has been secured.

2. Two-sided sheet according to claim 1, wherein the second travel-related item comprises a boarding pass which can be used as a passenger boarding pass by the passenger to board a transportation provider.

3. Two-sided sheet according to claim 1, wherein the second travel-related item comprises a baggage claim stub which can be used by the passenger to identify the piece of passenger luggage to which the baggage tag has been secured.

4. Two-sided sheet according to claim 1, wherein the second travel-related item comprises a baggage receipt for the passenger to show fees paid by the passenger for checked-in baggage.

5. Two-sided sheet according to claim 1, wherein the second travel-related item comprises a supplemental label having a promotional travel coupon printed thereon for redemption by the passenger.

6. A combined baggage tag and boarding pass for a passenger of a transportation provider, the combined baggage tag and boarding pass comprising:

a first facestock material having a back major surface and a front major surface on which baggage tag information is printed;

a second facestock material having a back major surface and a front major surface on which boarding pass information is printed; and adhesive disposed between the back major surface of the first facestock material and the back major surface of the second facestock material such that (i) at least a portion of the second facestock material can be peeled away and separated from the adhesive and the first facestock material and used by the passenger as a passenger boarding pass, and (ii) the first facestock material and at least a portion of the adhesive can be attached to a piece of passenger baggage and used by the passenger as a passenger baggage tag.

7. A combined baggage tag and boarding pass according to claim 6, wherein each of the first and second facestock material is coated with a thermal coating.

8. A combined baggage tag and boarding pass according to claim 6, wherein the first facestock material comprises material meeting requirements of International Air Transport Association (IATA) guidelines.

9. A combined baggage tag and boarding pass according to claim 6, wherein the second facestock material comprises Super Calendered Kraft (SCK) material.

10. A combined baggage tag and boarding pass according to claim 6, wherein (i) the first facestock material comprises material meeting requirements of International Air Transport Association (IATA) guidelines, and (ii) the second facestock material comprises Super Calendered Kraft (SCK) paper.

11. A combined baggage tag and boarding pass according to claim 6, wherein the second facestock material has at least one perforation for facilitating peeling away and separating at least a portion of the second facestock material from the adhesive and the first facestock material and thereby to allow the passenger to (i) use the separated portion of the second facestock material as the passenger boarding pass, and (ii) use the first facestock material and any remaining portion of the second facestock material as the passenger baggage tag.

12. A combined baggage tag and boarding pass according to claim 11, wherein at least one corner portion between the first facestock material and the second facestock material is substantially devoid of adhesive for facilitating peeling away and separating at least a portion of the second facestock material from the adhesive and the first facestock material and thereby to (i) use the separated portion of the second facestock material as the passenger boarding pass, and (ii) use the first facestock material and any remaining portion of the second facestock material as the passenger baggage tag.

13. A method of operating an apparatus to provide on-demand printing of a two-sided sheet item which contains a first travel-related item and a second travel-related item which is different from the first travel-related item, the method comprising:

printing baggage tag information onto a front major surface of the first travel-related item in the form of a baggage tag disposed on a first major side surface of the two-sided sheet item;

printing other information onto a front major surface of the second travel-related item in the form of a passenger-usable travel document disposed on a second major side surface of the two-sided sheet item; and delivering the first and second travel-related items together as a single sheet to provide a combined baggage tag and passenger-usable travel document in which the passenger-usable travel document can be peeled away and separated from the baggage tag so that the baggage tag can be secured to a piece of passenger luggage using at least a portion of exposed adhesive after the passenger-usable travel document has been peeled away and separated from the baggage tag, and (ii) the passenger-usable travel document can be used by a passenger associated with the piece of passenger luggage to which the baggage tag has been secured.

14. A method according to claim 13, wherein the passenger-usable travel document comprises a boarding pass which can be used by the passenger as a passenger boarding pass to board a transportation provider.

15. A method according to claim 13, wherein the passenger-usable travel document comprises a baggage claim stub which can be used by the passenger to identify the piece of passenger luggage to which the baggage tag has been secured.

16. A method according to claim 13, wherein the passenger-usable travel document comprises a baggage receipt for the passenger to show fees paid by the passenger for checked-in baggage.

17. A method according to claim 13, wherein the printed second travel-related item comprises a supplemental label having a promotional travel coupon printed thereon for redemption by the passenger.

* * * * *